US007273070B2

(12) United States Patent
Lin

(10) Patent No.: US 7,273,070 B2
(45) Date of Patent: Sep. 25, 2007

(54) SPOUT PLUMBING DEVICE

(76) Inventor: Tung-Po Lin, P.O. Box 697, Fongyuan City, Taichung County (TW) 420

( * ) Notice: Subject to any disclaimer, the term of this patent is extended or adjusted under 35 U.S.C. 154(b) by 151 days.

(21) Appl. No.: 11/287,260

(22) Filed: Nov. 28, 2005

(65) Prior Publication Data

US 2007/0119509 A1 May 31, 2007

(51) Int. Cl.
*F16L 5/00* (2006.01)

(52) U.S. Cl. ..... 137/801; 4/695; 137/359; 285/8

(58) Field of Classification Search ..... 4/675–678, 4/695; 137/15.08, 801, 356, 359; 411/112, 411/337; 285/8, 397
See application file for complete search history.

(56) References Cited

U.S. PATENT DOCUMENTS 1,383,126 A * 6/1921 Kraft ..... 285/12
5,381,830 A * 1/1995 Niemann et al. ..... 137/801
5,458,154 A * 10/1995 Niemann et al. ..... 137/801
5,464,045 A * 11/1995 Niemann et al. ..... 137/801
5,950,663 A * 9/1999 Bloomfield ..... 137/359
6,421,849 B1 * 7/2002 Gray ..... 4/675
6,615,422 B2 * 9/2003 Hecker ..... 4/675

* cited by examiner

*Primary Examiner*—Eric Keasel
*Assistant Examiner*—Craig Schneider

(57) ABSTRACT

A spout plumbing device includes a spout having an externally threaded water inlet on the bottom for engaging sequentially with a hexagonal nut, an expansion tube and a swivel cap which has a hexagonal central bore in upper portion engaged with the hexagonal nut, a less diameter circular central bore in lower portion engaged with the expansion tube which has a flange on the top stopped against an annular shoulder inside the swivel cap, an elastic sleeve sleeved on the lower portion of the expansion tube and engaged within a through hole of a worktop, a washer position between the swivel cap and the worktop when the swivel cap engages with the worktop and a water source connected to the lower end of the water inlet. It is characterized that this plumbing job is all worked on the top of the worktop and does not need to work in the narrow and dirty space under the worktop.

1 Claim, 6 Drawing Sheets

SPOUT PLUMBING DEVICE

BACKGROUND OF THE INVENTION

The present invention relates to spouts and more particularly to a spout plumbing device which aims to facilitate a rapid and readily installing the spout.

As we know that to install a spout to a kitchen sink. One has to fasten the spout under the worktop. The underside of the worktop is usually narrow and dirty with bad odor that causes the inconvenience and weariness to the plumbers.

FIG. 1 shows a prior art spout plumbing device which comprises generally a goose neck spout 10 above a base 11, and a water inlet pipe 12. The base 11 stops on the top of a worktop 15 of a kitchen sink. The worktop 15 has a passage 151 for facilitating the water inlet pipe 12 passing through. The water inlet pipe 12 has outer threads and is fastened by a first hexagonal nut 13 and a water source 16 connects to the water inlet pipe 12 by a second nut 14. Although, this goose neck spout 10 is positioned on the top of the worktop 15, but it has to be installed in a dirty and narrow space under the worktop 15 that causes inconvenience to the plumber.

FIG. 2 shows another prior art spout plumbing device which also comprises a goose neck spout 50, a base 51 stopped on the top of a worktop 52, a water inlet (not shown) protected by a threaded pipe 53 which is supported by a double clamping plate 55 with springs 54 thereon and secured by a nut 56 on the top of the clamping plate 55. The more upward movement, the more opening of the double clamping plate 55 so as to create the effort against the underside of the worktop 52 that pulls the spout 50 moving downward to tightly secure on the worktop 52. However, this spout plumbing device has although a little improvement, it has still to work in the dirty narrow space under the worktop 52, especially it has to make three through holes in the worktop 52 which is damageable unexpectedly.

SUMMARY OF THE PRESENT INVENTION the present invention has a main object to provide a spout plumping device which needs not to work under the worktop but on the top thereof to rapidly and readily install the spout so as to give great convenient to the plumber.

Accordingly, the spout plumping device of the present invention comprises generally a spout including a water inlet thereunder which has outer threads connecting to a water source through a hole in the worktop and a set of positioning part including a swivel cap, an expansion cylinder and an elastic sleeve by which the spout together with its water inlet will be readily secured on the top of the worktop.

The present invention will become more fully understood by reference to the following detailed description thereof when read in conjunction with the attached drawings.

DETAILED DESCRIPTION OF THE PREFERRED EMBODIMENT

Figure 1:
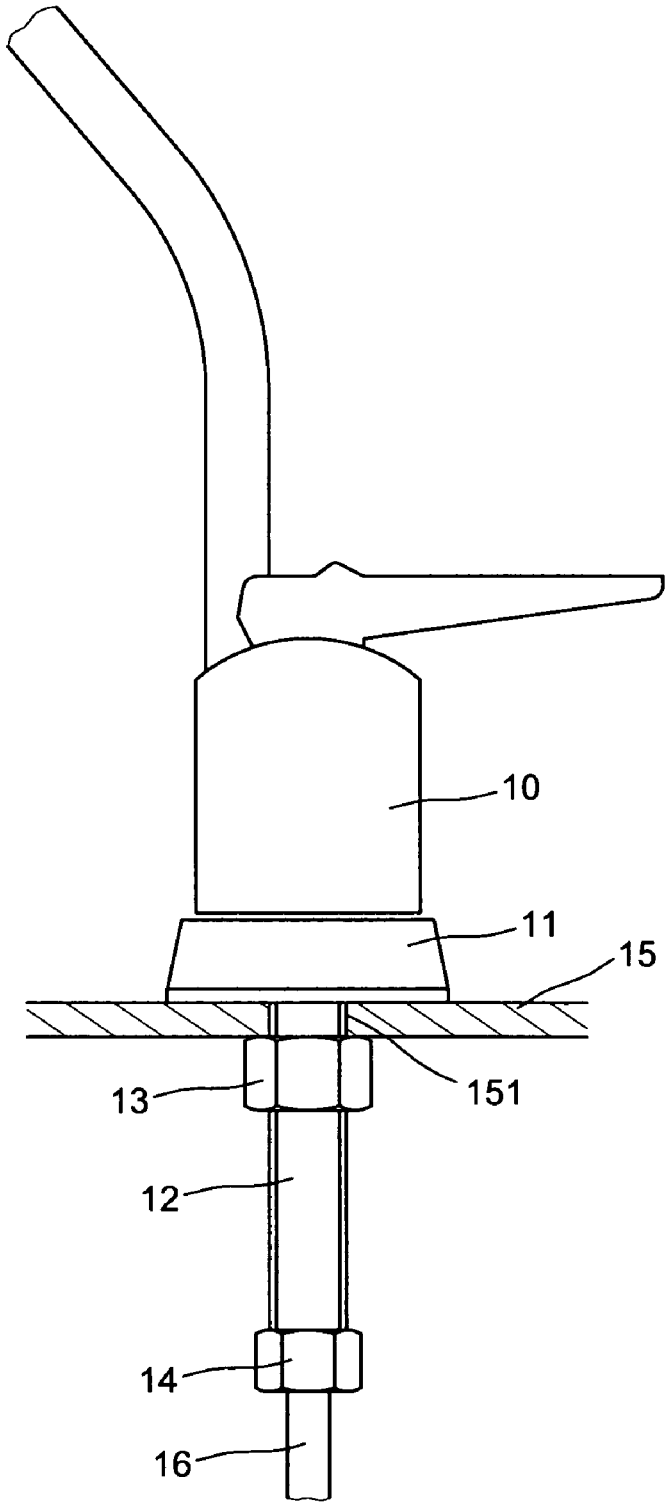
FIG.1 Prior Art
FIG. 1 is a plane view to show a spout plumbing device according a pair art.
Figure 2:
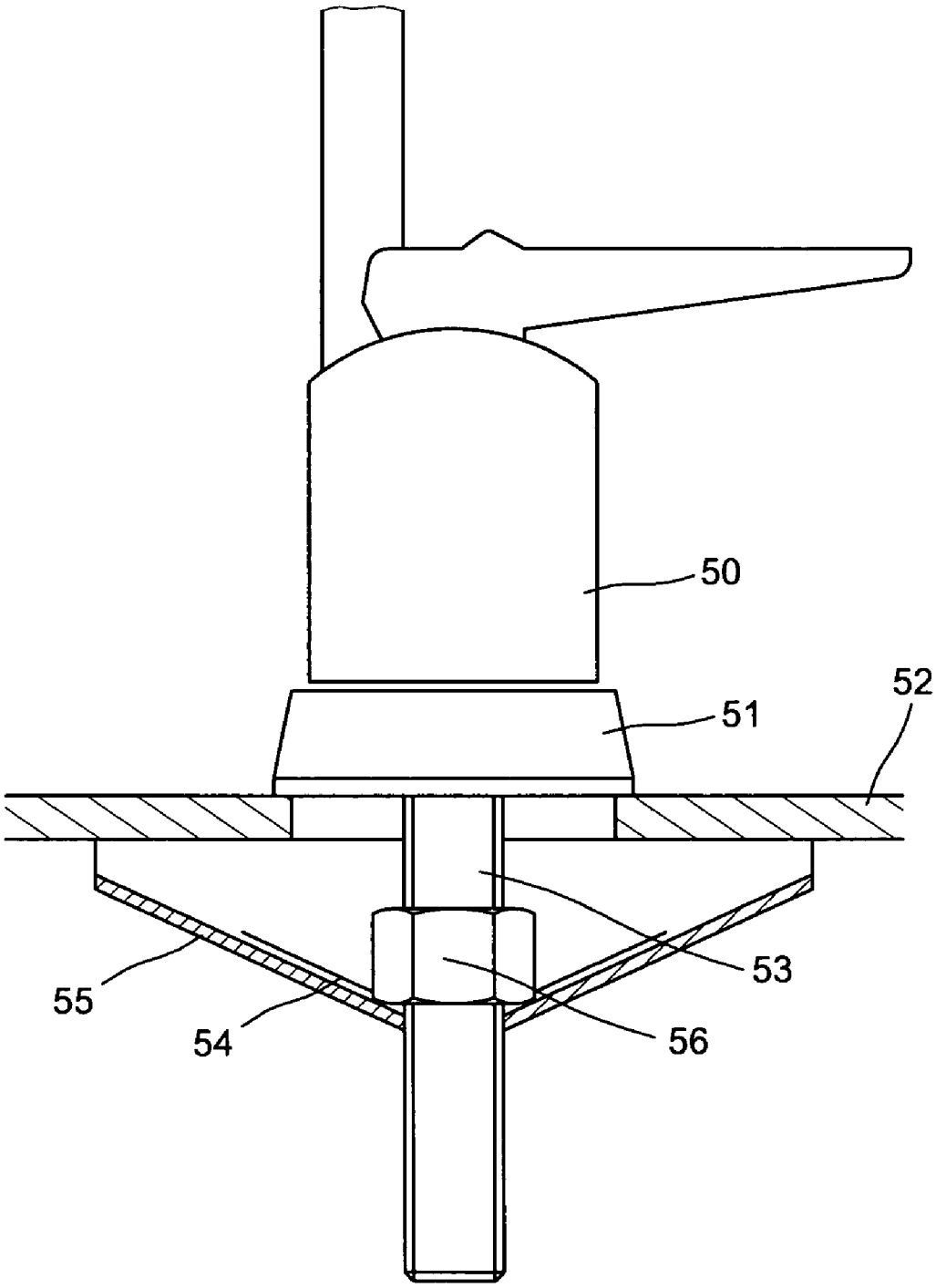
FIG.2 Prior Art
FIG. 2 is a plane view to show a spout plumping device according to another prior art.
Figure 3:
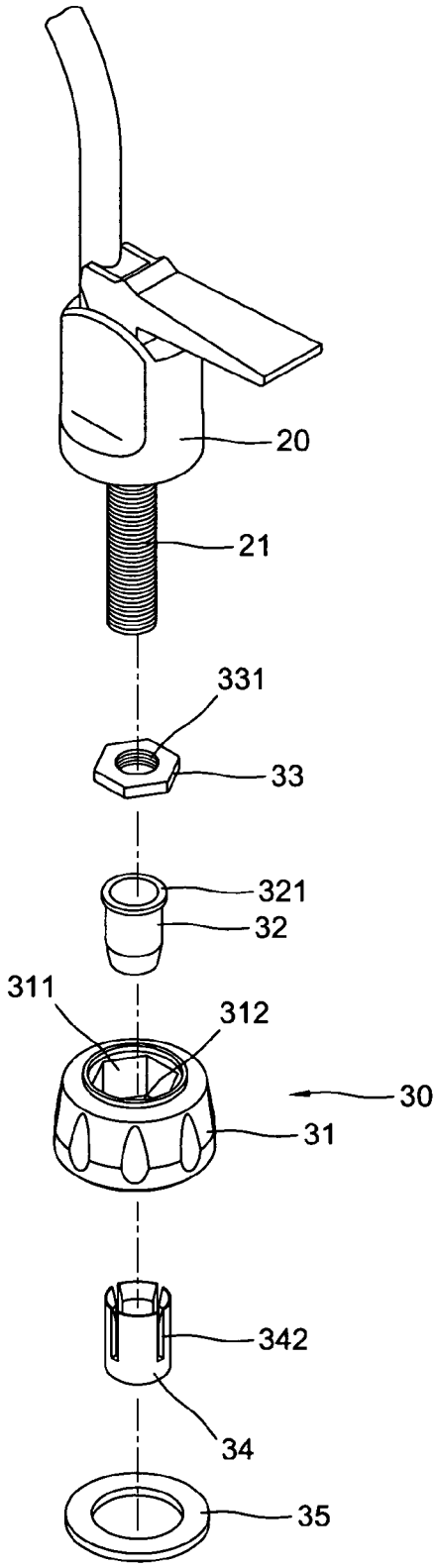
FIG. 3 is an exploded perspective view to show a spout plumping device of the present invention.
Figure 4:
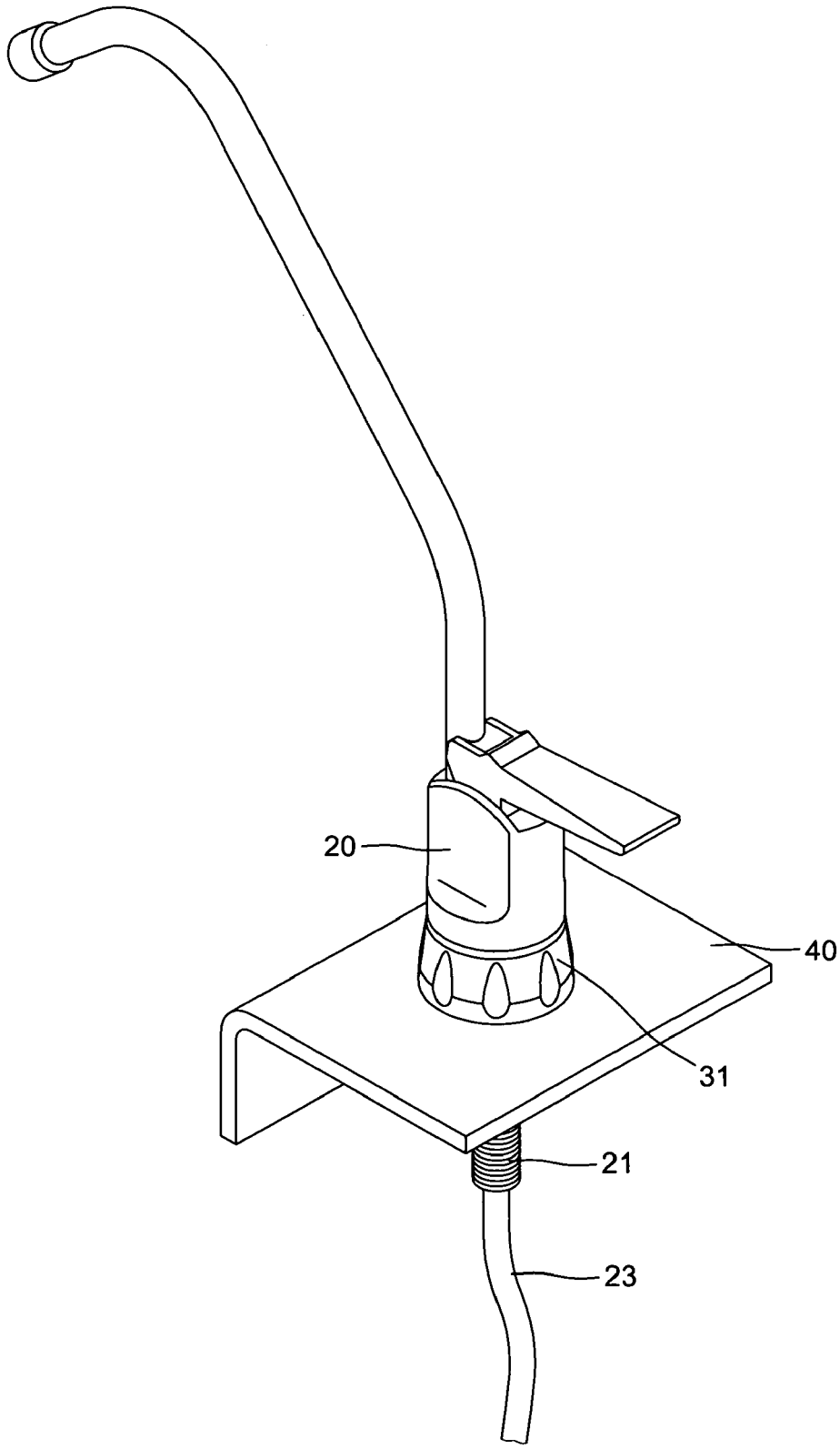
FIG. 4 is a perspective view to show the spout plumbing device of FIG. 3 installed on the top of the worktop of the kitchen sink.
Figure 5:
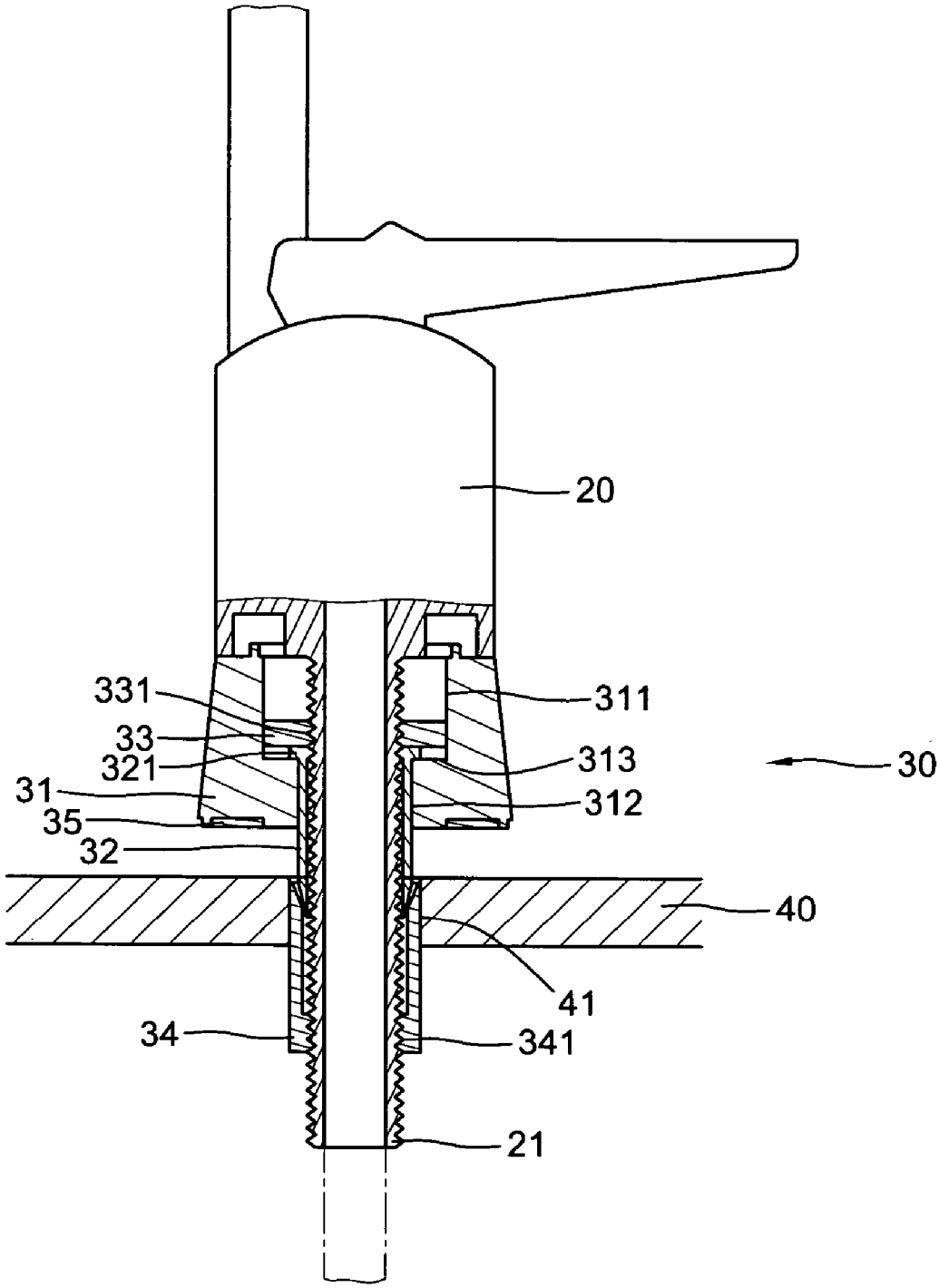
FIG. 5 is a sectional view of FIG. 4 under plumbing.

With reference to FIGS. 3 and 4 of the drawings, the spout plumbing device of the present invention comprises a spout 20 having an externally threaded water inlet 21 integrated under the bottom, a water source 23 connected to the water inlet 21 through a through hole 41 in a worktop 40 of a kitchen sink (as shown in FIG. 5), a plumping device 30 for securing the spout 20 on the top of the worktop 40 comprising a swivel cap 31 which has a hexagonal central bore 311 in upper portion communicated to a circular central bore 312 in lower portion, wherein the circular central bore 312 has a diameter lesser than that of the hexagonal central bore 311, a hexagonal nut 33 which has circular central hole 331 having inner thread engaged the external threads of the water inlet 21, an expansion tube 32 which has a flange 321 on upper rim sleeved on the water inlet 21 beneath the hexagonal nut 33 and a small central bore in the bottom, an elastic sleeve 34 which has a plurality of vertical slits 342 formed spaced apart in the periphery and interior threads 341 engaged with the external threads of the water inlet 21 and partially wrapped on the lower portion of the expansion tube 32.

Figure 6:
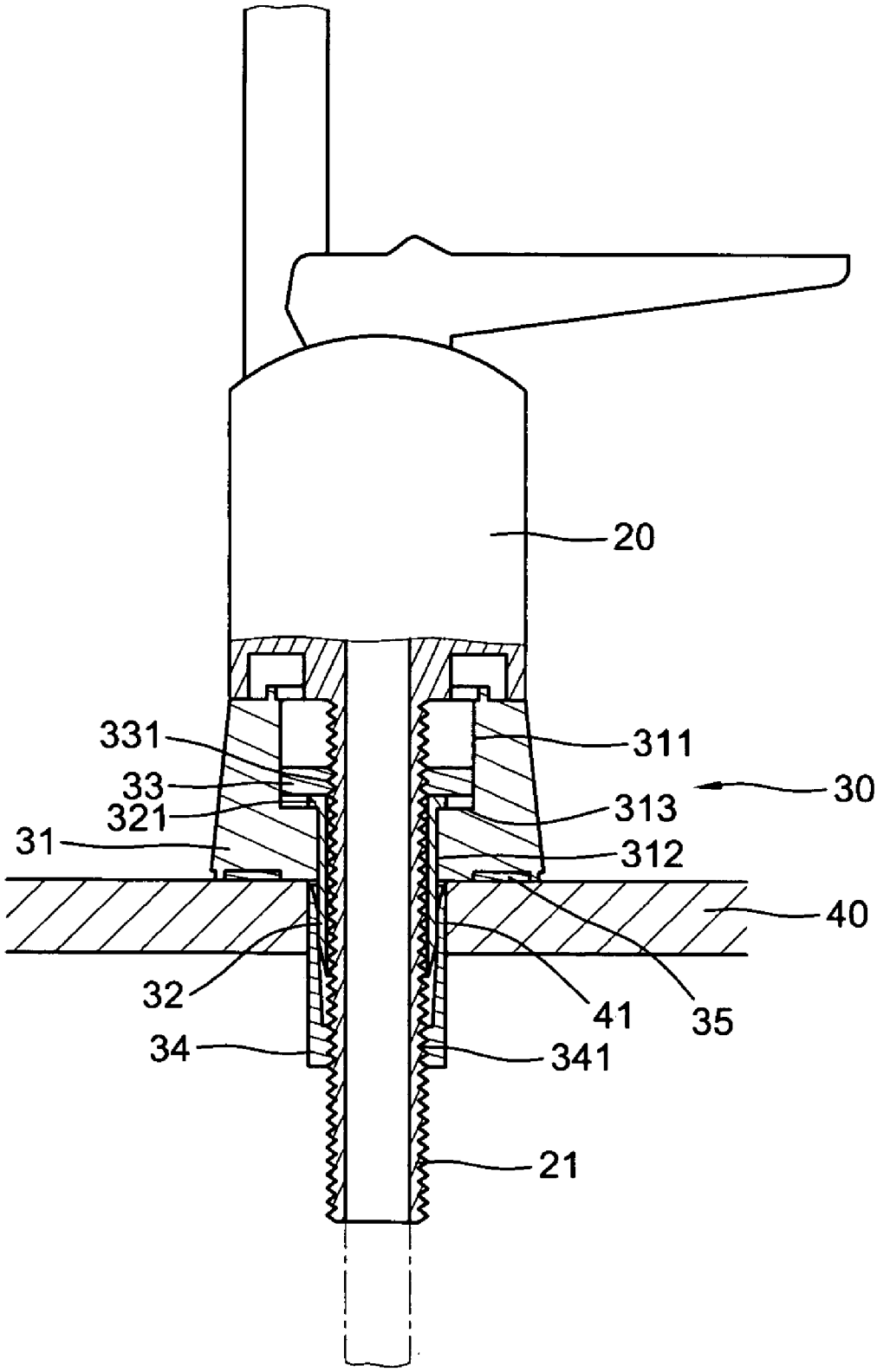
FIG. 6 is a section view of the spout plumbing device of the present invention after the installation.

When assembling (as shown in FIGS. 5 and 6), the hexagonal nut 33 engages within the hexagonal central bore 311 of the swivel cap 31 and the expansion tube 32 positions in the circular central bore 312 with its flange 321 stopping against an annular shoulder 313 inside the cap 31. When the swivel cap 31 engages with the top of the worktop 40, a washer 35 is positioned therebetween. Meanwhile, the elastic sleeve 34 under the squeezing of the expansion tube 32 will be diametrically enlarged to tightly engage within the through 41 of the worktop 40. So that the spout 20 is completely secured on the top of the worktop 40.

The installation of the spout 20 with the spout plumping device of the present invention does not need to work under the worktop 40. If changes or repairs the spout 20, loosens the swivel cap 31 to have the spout 20 moving upward for a distance so as to disengage the expansion tube 32 with the elastic sleeve 34, then swivels the spout 20 which becomes removable. Further, the spout plumbing device of the present invention adopts any type of the worktop. No matter the worktop is thick or thin.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A spout plumbing device comprising:

a spout having an externally threaded water inlet integrated with bottom thereof;

a hexagonal nut having internally threaded circular central hole engaged with the water inlet;

an expansion tube having a flange at upper rim sleeved on the water inlet beneath said hexagonal nut;

a swivel cap having a hexagonal central bore in an upper portion engaged with said hexagonal nut, a less diameter circular central bore in a lower portion engaged with said expansion tube and an annular shoulder in an inner periphery engaged with the flange of said expansion tube;

an elastic sleeve sleeved on lower portion of said expansion tube and engaged with a through hole in a worktop;

a washer positioned between said swivel cap and said worktop when said swivel cap engages with said worktop; and a water source connected to lower end of said water inlet.

* * * * *